US010883344B2

(12) United States Patent
Greci et al.

(10) Patent No.: US 10,883,344 B2
(45) Date of Patent: Jan. 5, 2021

(54) SYSTEMS AND METHODS FOR OPENING SCREEN JOINTS

(71) Applicant: Halliburton Energy Services, Inc., Houston, TX (US)

(72) Inventors: Stephen Michael Greci, Little Elm, TX (US); Brandon Thomas Least, Flower Mound, TX (US); Thomas J. Frosell, Irving, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 59 days.

(21) Appl. No.: 16/316,003

(22) PCT Filed: Aug. 24, 2016

(86) PCT No.: PCT/US2016/048431
§ 371 (c)(1),
(2) Date: Jan. 7, 2019

(87) PCT Pub. No.: WO2018/038724
PCT Pub. Date: Mar. 1, 2018

(65) Prior Publication Data

US 2019/0257177 A1 Aug. 22, 2019

(51) Int. Cl.
*E21B 43/08* (2006.01)
*E21B 43/119* (2006.01)
(Continued)

(52) U.S. Cl.
CPC ..... *E21B 43/08* (2013.01); *E21B 23/02* (2013.01); *E21B 29/005* (2013.01); *E21B 34/08* (2013.01);
(Continued)

(58) Field of Classification Search
CPC ..... E21B 23/02; E21B 23/00; E21B 29/002; E21B 29/005; E21B 29/007; E21B 29/08;
(Continued)

(56) References Cited

U.S. PATENT DOCUMENTS 2,023,064 A * 12/1935 Clasen ..... E21B 37/08 166/55.2
4,510,996 A * 4/1985 Hardin ..... B01D 29/15 166/227
(Continued)

FOREIGN PATENT DOCUMENTS

WO 2011008544 1/2011
WO 2015073011 5/2015

OTHER PUBLICATIONS

International Search Report and Written Opinion of PCT Application No. PCT/US2016/048431 dated May 22, 2017: pp. 1-18.

*Primary Examiner* — Kenneth L Thompson
(74) *Attorney, Agent, or Firm* — Chamberlain Hrdlicka

(57) ABSTRACT

Example systems and methods are described that operate to open screen joints using mechanically-generated perforations for beginning fluid production. In an example system, a screen joint is deployed in a production tubing within a wellbore. The screen joint includes a screen element and a blank housing that are coupled to an exterior surface of a non]perforated base pipe. Further, the screen joint includes a locator profile positioned along an interior surface of the non]perforated base pipe. A perforator is deployed within the screen joint that includes a mechanical perforator and a locator for engaging with the locator profile to position the mechanical perforator under the blank housing.

12 Claims, 4 Drawing Sheets

(51) Int. Cl.

| | |
|---|---|
| ***E21B 23/02*** | (2006.01) |
| ***E21B 29/00*** | (2006.01) |
| ***E21B 43/112*** | (2006.01) |
| ***E21B 34/08*** | (2006.01) |
| *E21B 43/14* | (2006.01) |

(52) U.S. Cl.
CPC ..... *E21B 43/112* (2013.01); *E21B 43/119* (2013.01); *E21B 43/14* (2013.01)

(58) Field of Classification Search
CPC ..... E21B 43/08; E21B 43/112; E21B 43/11; E21B 43/119
See application file for complete search history.

(56) References Cited

U.S. PATENT DOCUMENTS

| | | | | |
|---|---|---|---|---|
| 7,383,886 | B2 * | 6/2008 | Dybevik | E21B 43/119 166/227 |
| 7,422,071 | B2 * | 9/2008 | Wilkie | E21B 33/1208 166/179 |
| 7,730,949 | B2 * | 6/2010 | Guignard | E21B 29/08 166/296 |
| 8,136,584 | B2 | 3/2012 | Burnett et al. | |
| 8,403,052 | B2 | 3/2013 | Veit | |
| 2008/0308274 | A1 * | 12/2008 | MacDougall | E21B 33/12 166/278 |
| 2009/0078421 | A1 | 3/2009 | Guignard et al. | |
| 2009/0283271 | A1 * | 11/2009 | Langeslag | E21B 34/063 166/297 |
| 2013/0014953 | A1 | 1/2013 | van Petegem | |
| 2014/0083686 | A1 | 3/2014 | Richards et al. | |
| 2015/0226041 | A1 | 8/2015 | Holderman et al. | |

* cited by examiner

SYSTEMS AND METHODS FOR OPENING SCREEN JOINTS

BACKGROUND

During the completion of oil and gas wells that traverse hydrocarbon-bearing formations, production tubing and completion equipment are often installed in the wells to enable production of formation fluids. For example, to control the flow rate of production fluids into production tubing, it is common practice to install one or more flow control devices within the tubing string. In some instances, a wellbore is completed in a formation that is loose or "unconsolidated." As production fluids are produced into the wellbore from unconsolidated or loosely consolidated formations, formation particles (e.g., sand) can invade the wellbore. Such particles pose problems by reducing production efficiency, increasing production costs and wearing and/or damaging both downhole and surface components. For example, the particles are detrimental to production equipment and can be erosive to downhole pumps as well as to pipes, valves, and fluid separation equipment at the surface.

To prevent the production of particulate material from subterranean formations, certain completions include one or more screens positioned proximate desired production zones. The screens are often disposed on the exterior surface of production tubing and filters formation fluid as it enters the tubing string. Sliding sleeves can be used to isolate the screens from formation fluids, preventing fluid flow from entering the tubing string until hydrocarbon production is desired. The sliding sleeves are mechanically shifted from a closed to an open position to expose the flow control devices and screens to formation fluids, and may thereafter open fluid flow into the tubing string. However, the shifting of sliding sleeves is often unreliable due to debris and corrosion of sliding sleeve components in downhole environments. As a result, it can be difficult for operators to begin hydrocarbon fluid production due to difficulties with reliably opening sliding sleeves to allow flow of fluids into the production tubing.

DETAILED DESCRIPTION

To address some of the challenges described above, as well as others, systems and methods are described herein that operate to open screen joints using mechanically-generated perforations for beginning fluid production.

Figure 1:
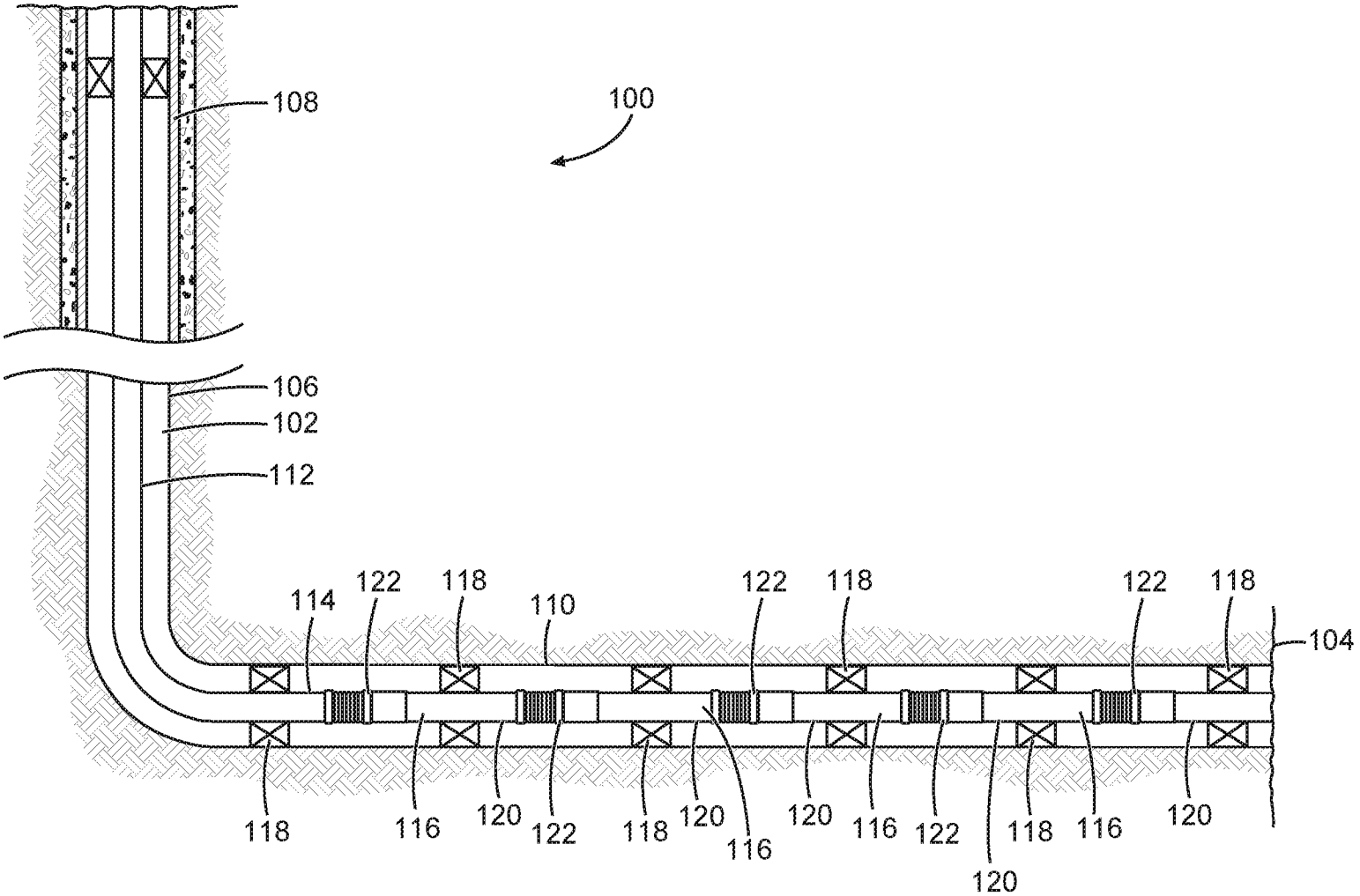
FIG. 1 is a schematic diagram illustrating an example well system, according to one or more embodiments.

FIG. 1 is a schematic diagram illustrating an example well system 100, according to one or more embodiments. In well system 100, a wellbore 102 is drilled extending through various earth formations into a formation of interest 104 containing hydrocarbons. Those skilled in the art will readily recognize that the principles described herein are applicable to land-based, subsea-based, or sea-based operations, without departing from the scope of the disclosure. The wellbore 102 includes a substantially vertical section 106, the upper portion of which is cased by a casing string 108 that is cemented in place inside the wellbore 102. The wellbore 102 also includes a substantially horizontal section 110 that extends through the formation of interest 104.

As illustrated, the horizontal section 110 of the wellbore 102 is open hole. However, those skilled in the art will readily recognize that the principles described herein are also applicable to embodiments in which the horizontal section 110 of the wellbore 102 includes borehole-lining tubing, such as casing and/or liner. Further, although FIG. 1 depicts a well having a horizontal section 110, it should be understood by those skilled in the art that this disclosure is also applicable to well systems having other directional configurations including, but not limited to, vertical wells, deviated well, slanted wells, multilateral wells, and the like.

Accordingly, it should be understood that the use of directional terms such as "above", "below" "upper", "lower", "left", "right" "uphole", "downhole" and the like are used in relation to the illustrative embodiments as they are depicted in the figures, the above direction being toward the top of the corresponding figure, the below direction being toward the bottom of the corresponding figure, and the uphole direction being toward the surface of the well and the downhole direction being toward the toe of the wellbore 102, even though the wellbore or portions of it may be deviated or horizontal. Correspondingly, the "transverse" or "radial" orientation shall mean the orientation perpendicular to the longitudinal or axial orientation. In the discussion which follows, generally cylindrical well, pipe and tube components are assumed unless expressed otherwise.

A tubular 112 (e.g., production tubing) extending from the surface is suspended inside the wellbore 102 for recovery of formation fluids to the earth's surface. The tubular 112 provides a conduit for formation fluids to travel from the formation of interest 104 to the surface and can also be used as a conduit for injecting fluids from the surface into the formation of interest 104. At its lower end, tubular 112 is coupled to a completion string 114 that has been installed in wellbore 102 and divides the horizontal section 110 into various production intervals.

The completion string 114 includes a plurality of screen joints 116 that are coupled together sequentially to form the completion string 114. Each of the screen joints 116 are positioned between packers 118 that provide a fluidic seal between the completion string 114 and the wellbore 102, thereby defining the production intervals. Each screen joint can include a base pipe 120 and a flow control screen 122 that circumferentially surrounds at least a portion of the base pipe 120. Even though FIG. 1 depicts one flow control screen 122 in each production interval, it should be understood by those skilled in the art that any number of flow control screens can be deployed within a production interval without departing from the principles of the present invention.

The flow control screens 122 of the screen joints 116 operate to filter unwanted particulates and other solids from formation fluids as the formation fluids enter the completion string 114. As described herein, "formation fluids" refers to hydrocarbons, water, and any other substances in fluid form that may be produced from an earth formation. It should be understood that the terms "flow control screen" or "screen" as used herein are intended to embrace all types of similar structures which are commonly used in blocking the flow of particulates (e.g., other commercially-available screens, slotted or perforated liners or pipes; sintered-metal screens; sintered-sized, mesh screens; screened pipes; prepacked screens and/or liners; or combinations thereof).

In some embodiments, the base pipes 120 are pipe segments that include suitable connection mechanisms, such as threaded configurations, to connect each screen joint 116 to adjacent components. For example, adjacent pairs of screen joints 116 are coupled together at a screen joint connection (not shown), with the number of screen joints 116 and screen joint connections varying depending on the length of the screen joints and the wellbore in which they are deployed.

It is to be recognized that system 100 is merely exemplary in nature and various additional components can be present that have not necessarily been depicted in FIG. 1 in the interest of clarity. Non-limiting additional components that can be present include, but are not limited to, supply hoppers, valves, condensers, adapters, joints, gauges, sensors, compressors, pressure controllers, pressure sensors, flow rate controllers, flow rate sensors, temperature sensors, and the like. Such components can also include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, and the like), logging tools and related telemetry equipment, actuators (e.g., electromechanical devices, hydromechanical devices, and the like), sliding sleeves, production sleeves, screens, filters, flow control devices (e.g., inflow control devices, autonomous inflow control devices, outflow control devices, and the like), couplings (e.g., electro-hydraulic wet connect, dry connect, inductive coupler, and the like), control lines (e.g., electrical, fiber optic, hydraulic, and the like), surveillance lines, drill bits and reamers, sensors or distributed sensors, downhole heat exchangers, valves and corresponding actuation devices, tool seals, packers, cement plugs, bridge plugs, and other wellbore isolation devices or components, and the like. Any of these components can be included in the well system 100 generally described above and depicted in FIG. 1.

Figure 2:
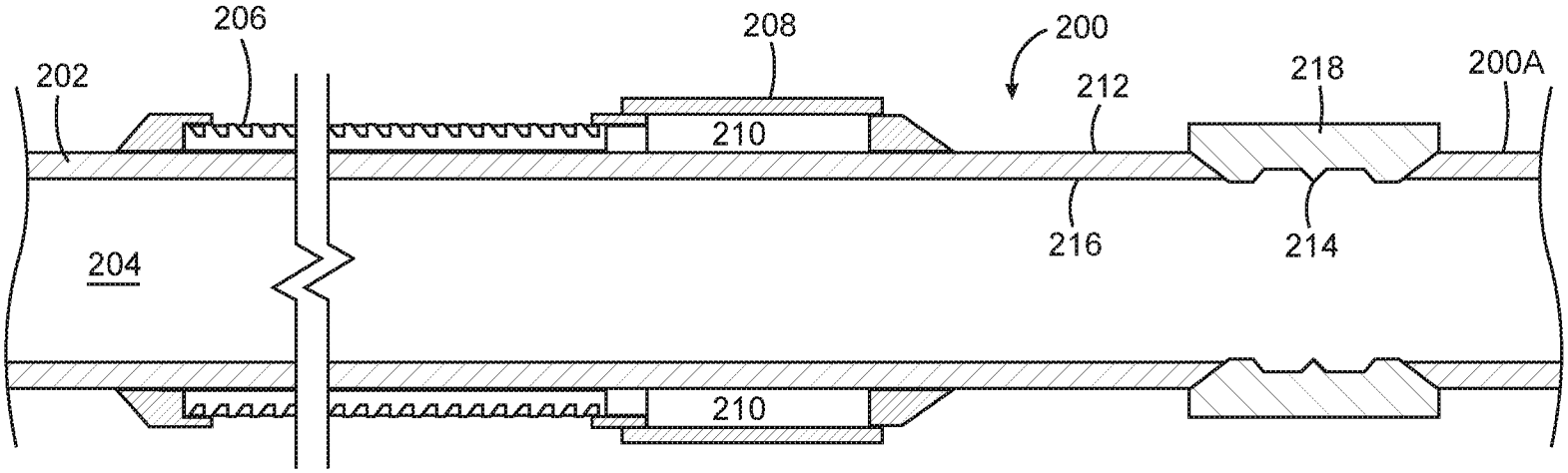
FIG. 2 is a longitudinal view of a screen joint, according to one or more embodiments.

FIG. 2 is a longitudinal view of a screen joint 200, according to one or more embodiments. In one embodiment, the screen joint 200 includes a base pipe 202 comprising a tubular member, which can be made of a material such as a steel alloy, that defines an axial throughbore 204 that allows passage of fluids. The screen joint 200 can be a rigid tubular that maintains its shape when deployed downhole and that allows formation fluid to pass through.

In use, the screen joint 200 is coupled to and forms part of a completion string (such as completion string 114 described above in relation to FIG. 1) that is run into a borehole. For example, the screen joint 200 can be coupled at both its uphole and downhole end to other screen joints (e.g., screen joint 200A) to form a portion of the completion string. The screen joints (e.g., screen joints 200 and 200A) are coupled together so that their axial throughbores 204 are substantially contiguous.

Each screen joint 200 includes a screen element 206 and a blank housing 208 that are each positioned around the base pipe 202 so as to define an annular chamber 210 therebetween. The screen element 206 is of a material and configuration that operates to allow fluid flow through, while preventing particulate materials from passing. In some embodiments, the screen element 206 comprises a wire wrap screen or another filter medium wrapped radially around the external circumferential surface 212 of base pipe 202. In some embodiments, the blank housing 208 is a permanent sleeve that is coupled to the base pipe 202. For example, the blank housing 208 can be welded or otherwise permanently coupled to the base pipe 202.

The screen element 206 is secured in concentric relation around the exterior surface of the base pipe 202 along a first axial region. The blank housing 208 is also secured in concentric relation around the exterior surface of the base pipe 202, but is positioned along a second axial region. The screen element 206 and blank housing are concentric with each other along at least a portion of their respective lengths, and further are configured in series relative to each other along the axial length of the base pipe 202. The screen element 206 and blank housing 208 define an annulus (e.g., annular chamber 210) surrounding the base pipe 202.

In one embodiment, such as depicted in FIG. 2, the screen element 206 and blank housing 208 extend fully around the external circumferential surface 212 of the base pipe 202. In this example, the annular chamber 210 can be concentric with the base pipe 202. In other embodiments, the screen element 206 and blank housing 208 extend partially around the external circumferential surface 212 of the base pipe 202.

While the base pipe of a conventional screen joint is often perforated to permit the passage of fluid into or from the completion string, the base pipe 202 of screen joint 200 comprises a solid tubular that is substantially impenetrable to formation fluids in the wellbore surrounding the screen joint 200. The base pipe 202 does not contain any ports or openings for permitting the lateral passage of fluid, and can also be referred to as a "solid base pipe," which is unperforated. While formation fluids may pass through the screen element 206 of the screen joint 200 into the annular chamber 210, formation fluids cannot enter into the interior, axial throughbore 204 since the base pipe 202 is non-perforated.

In order to allow fluid flow between the annular chamber 210 and the axial throughbore 204, a communication path must be established. Screen joint 200 can be opened to fluid flow by creating an opening in the base pipe 202 under the blank housing 208. In some embodiments, a mechanical perforator (not shown in FIG. 2), which will be discussed in greater detail below, can be used to perforate through the sidewall of the base pipe 202.

The mechanical perforator can be positioned by lowering it downhole to engage with a locator profile 214 provided along the inner circumferential surface 216 of the screen joint 200. As illustrated in FIG. 2, the locator profile 214 is provided at a screen joint connection 218 that couples screen joint 200 at its downhole end to screen joint 200A. In some embodiments, the screen joint connection 218 can include threaded configurations (not shown) to couple screen joint 200 to screen joint 200A by threading the screen joints together. In other embodiments, the screen joint connection 218 can be made in any suitable fashion including welding, fastening using pins, set screws, and other connection mechanisms.

Those skilled in the art will readily recognize that the principles described herein are also applicable to embodiments in which the locator profile 214 is provided at a different position along the completion string. For example, in some embodiments, the locator profile 214 can be machined formed directly in the wall of the base pipe 202 along its inner circumferential surface 216. In other embodiments, the locator profile 214 can be provided in a separate sub (not shown) that is coupled inbetween screen joints along the completion string.

Further, although the example embodiments are described herein as having a mechanical-based locator profile for positioning the perforator, those skilled in the art will readily recognize that the principles described herein are also applicable to embodiments having sensor-based systems for positioning the perforator. For example, proximity sensors using radio frequency identification (RFID) tags can be used to detect that the perforator is positioned to create an opening in the base pipe.

Figure 3:
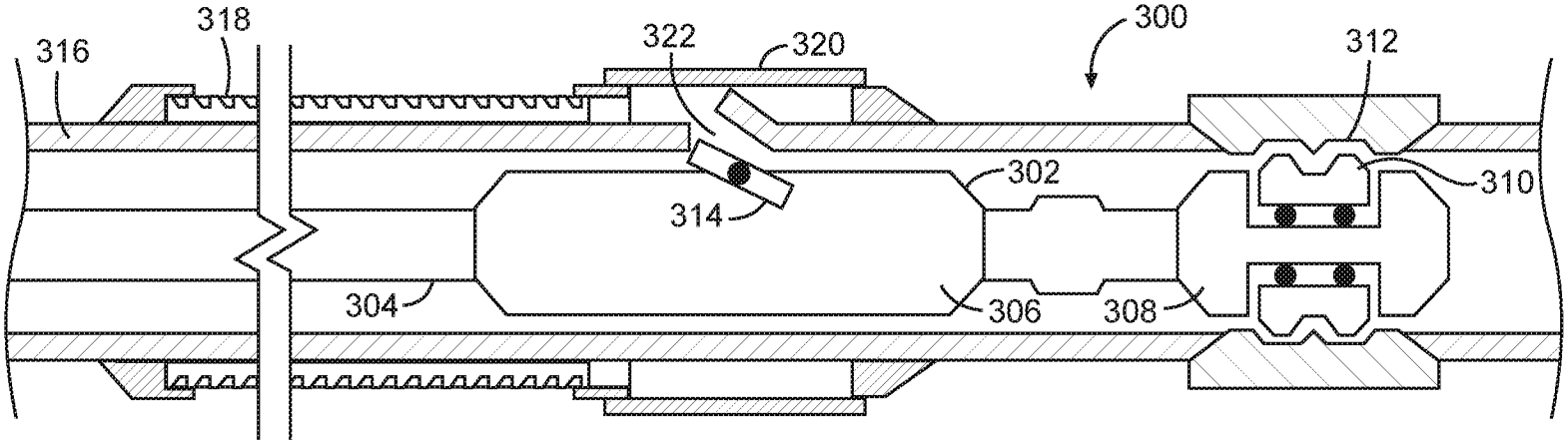
FIG. 3 is a longitudinal view of a screen joint assembly, according to one or more embodiments.

Referring now to FIG. 3, a longitudinal view of a screen joint assembly 300 is illustrated, according to one or more embodiments. The structure and functionality of the screen joint components were previously described in more detail with relation to screen joint 200 of FIG. 2, and thus, the details will not be repeated for the sake of simplicity. A non-perforated base pipe (e.g., base pipe 202 in FIG. 2) serves to isolate formation fluids from the completion string by blocking inflow of production fluid from surrounding formations. When it is desired to begin production of hydrocarbons, a perforator can be run into the screen joint assembly 300 and operated to open the screen joint to permit fluid ingress for production.

A downhole, perforator assembly 302 is illustrated as having been lowered into the completion string on a conveyance 304 such as a wireline, a slickline, coiled tubing, jointed tubing, downhole robot or the like. The perforator assembly 302 includes a mechanical perforator 306 and a locator 308. FIG. 3 shows the perforator assembly 302 after it has been conveyed into position using locator keys 310 of the locator 308 to engage with locator profile 312 of the screen joint assembly 300.

The mechanical perforator 306 includes a cutting element 314 that is designed to precisely penetrate only the base pipe 316, without further penetrating other elements of the screen joint assembly 300, such as the screen element 318 and blank housing 320 (previously described in FIG. 2) positioned around the base pipe 316. As depicted in FIG. 3, the mechanical perforator 306 is axially displaced from the locator 308 such that the cutting element 314 is positioned along the axial length of base pipe 316 at a position below the blank housing 320.

The cutting element 314, when activated, extends radially outward from the mechanical perforator 306. As the cutting element 314 extends radially outward, it comes into cutting contact with and through the sidewall of base pipe 316, thereby perforating the base pipe 316. In various embodiments, the annular space between the base pipe 316 and the blank housing 320 has sufficient space to bend the sidewall of base pipe 316 upwards, as illustrated in FIG. 3. After creating an opening in the side wall 316, a fluid passageway 322 is formed that allows fluid flow from outside of the screen joint assembly 300 to pass through screen element 318, through the annular space, and subsequently and into the interior (e.g., axial throughbore 204 as described in FIG. 2) of the screen joint assembly 300. The annular space operates as a flow chamber for porting fluid into the screen joint assembly after the fluid has been filtered by screen element 318.

In some embodiments, the mechanical perforator 306 includes an outer housing and a mandrel positioned within the outer housing. The mandrel is slidable along an axial length of the outer housing. The cutting element 314 is rotatably mounted to the mandrel using a pin. Further, the mandrel is coupled to an actuator, such as one from a downhole power unit. In operation, as the mandrel is axially shifted relative to the outer housing by the actuator, the cutting element 314 rotates about the pin and moves radially outwards of the outer housing, as illustrated in FIG. 3. As the cutting element 314 rotates outwards, a cutting surface of the cutting element 314 comes into contact with an inner circumferential surface of the base pipe 316. However, one of ordinary skill in the art will recognize that this disclosure is not limited to any particular perforator assemblies, and that the embodiments described are provided for example purposes only. The embodiments can also make use of mechanical perforators such as described in a recently published PCT application: WO2015073011A1.

The mechanical perforator 306 is axially separated from the locator 308 at a pre-determined distance to insure that the cutting element only base pipe 316 under the blank housing 320. If the base pipe 316 is perforated at a portion that is not positioned under blank housing 320, the resulting opening would allow formation fluid to enter the interior of the screen joint assembly 300 without passing through screen element 318, and thus, would contain undesirable particulates. Similarly, if the base pipe 316 is perforated at a portion that is under the screen element 318, the portion of base pipe 316 that is bent upwards can damage the screen element 318.

In some embodiments, the base pipe 316 can be perforated at a position that is under the screen element 318 if there is a sufficiently large gap between the outer diameter of the base pipe 316 and the inner diameter of the screen element 318. Alternatively, the base pipe 316 can be perforated at a position that is under the screen element 318 if a precise cutting tool is used that cuts through the base pipe only and does not damage the screen element 318. In such embodiments having perforations created under the screen element 318, a blank housing external to the base pipe 316 is not needed. Fluid flow from outside of the screen joint can pass through screen element 318 and into the interior (e.g., axial throughbore 204 as described in FIG. 2) of the screen joint through the perforation created under the screen element 318.

In some embodiments, after fluid passageway 322 is created, the perforator assembly 302 can be retrieved to the surface prior to hydrocarbon production. In other embodiments, the locator keys 310 can be retracted and/or pushed out of engagement with locator profile 312 for axially re-positioning the perforator assembly 302 relative to the base pipe 316. For example, the perforator assembly 302 can be pulled uphole or pushed downhole for opening a different screen joint to fluid flow.

Figure 4:
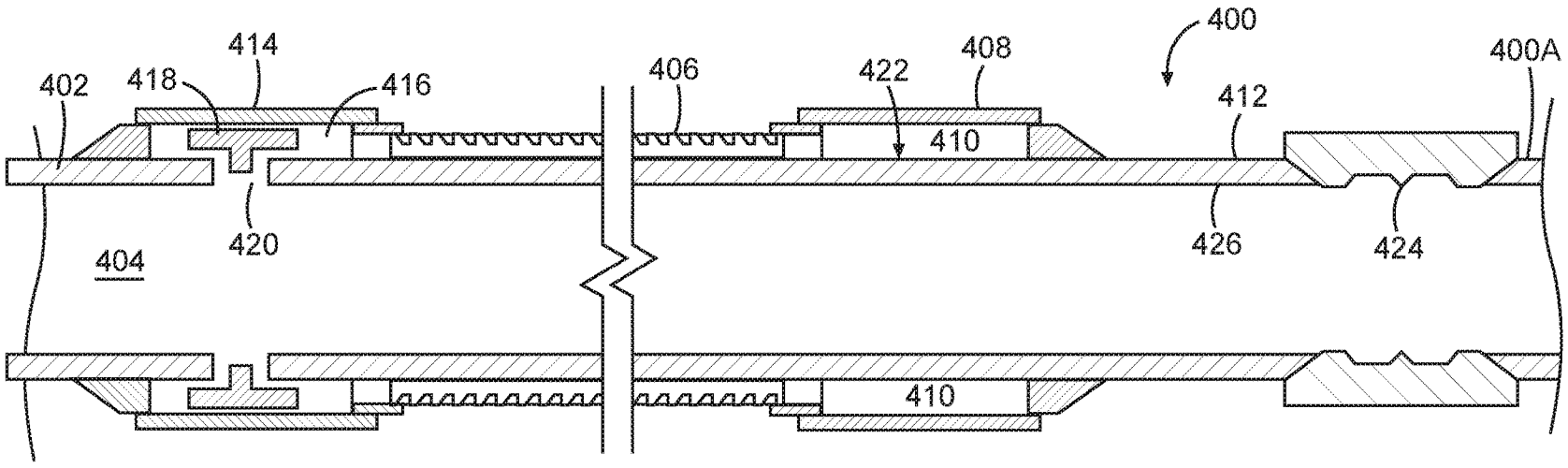
FIG. 4 is a longitudinal view of a second example of a screen joint, according to one or more embodiments.

FIG. 4 is a longitudinal view of a second example of a screen joint 400, according to one or more embodiments. In one embodiment, the screen joint 400 includes a base pipe 402 comprising a tubular member, which can be made of a material such as a steel alloy, and defining an axial throughbore 404 that allows passage of fluids. The screen joint 400 can be a rigid tubular that maintains its shape when deployed downhole and that allows formation fluid to pass through.

In use, the screen joint 400 is coupled to and forms part of a completion string (such as completion string 114 described above in relation to FIG. 1) that is run into a borehole. For example, the screen joint 400 can be coupled at both its uphole and downhole end to other screen joints (e.g., screen joint 400A) to form a portion of the completion string. The screen joints (e.g., screen joints 400 and 400A) are coupled together so that their axial throughbores 404 are substantially contiguous.

A screen element 406 and a blank housing 408 are positioned around the base pipe 402 so as to define an annular chamber 410 therebetween. The screen element 406 is comprised of a material that operates to allow fluid flow through, while preventing particulate materials from passing. In some embodiments, the screen element 406 comprises a wire wrap screen or another filter medium wrapped around the external circumferential surface 412 of base pipe 402. In some embodiments, the blank housing 408 is a permanent sleeve that is coupled to the base pipe 402. For example, the blank housing 408 can be welded or otherwise permanently coupled to the base pipe 402. In one embodiment, such as depicted in FIG. 4, the screen element 406 and blank housing 408 extend fully around the external circumferential surface 412 of the base pipe 402. In other embodiments, the screen element 406 and blank housing 408 extend partially around the external circumferential surface 412 of the base pipe 402.

The screen joint 400 further includes a second blank housing 414 positioned around the base pipe 402 so as to define a second annular chamber 416 therebetween. In some embodiments, the second blank housing 414 is a permanent sleeve that is coupled to the base pipe 402. For example, the blank housing 408 can be welded or otherwise permanently coupled to the base pipe 402. In one embodiment, such as depicted in FIG. 4, the second blank housing 414 extends fully around the external circumferential surface 412 of the base pipe 402. In other embodiments, the second blank housing 414 extends partially around the external circumferential surface 412 of the base pipe 402.

A flow control device 418 is positioned within the second annular chamber 416 that is configured to regulate the rate of fluid inflow into the screen joint 400. The flow control device 418 can have a number of alternative constructions that ensure selective operation and controlled fluid flow through the second annular chamber, including various inflow control device (ICD) and autonomous ICD configurations as is known to those skilled in the art. In some embodiments, the flow control device 418 can be responsive to control signals transmitted from a surface and/or downhole location. In other embodiments, the flow control device 418 can be adaptive to the wellbore environment. For example, the flow control device 418 can control fluid flow in response to changes in ratios in fluid mixture compositions, temperatures, density and other such parameters.

In some embodiments, the flow control device 418 can be configured to respond to pressure variations between the inside, axial throughbore 404 and the second annular chamber 416. As illustrated in FIG. 4, the flow control device can include a radially-movable member portion disposed in the opening 420 between the axial throughbore 404 and second annular chamber 416. The flow control device 418 can include a biasing member (not shown, but can comprise a spring, diaphragm, or other radially expandable device configured to bias the flow control device 418 in an open position (e.g., as illustrated in FIG. 4) that allows formation fluids to pass through the opening 420. However, in the presence of high fluid pressure from upstream fluid flow in the second annular chamber 416, the flow control device radially translates to move the flow control device 418 towards a closed position (not shown) that chokes or closes fluid flow into the axial throughbore. Although the positioning of the flow control device 418, as illustrated in FIG. 4, is radially aligned with the base pipe 402, other configurations can be used without departing from the scope of this disclosure. For example, in other embodiments, the flow control device can be axially aligned with the base pipe 402 to control fluid flow through the second annular chamber 416 before passing through opening 420.

In one embodiment, after formation fluid passes through screen element 406 and into the second annular chamber 416, the flow control device 418 operates by choking the pressure, and thus the inflow rate, of formation fluids flowing into the screen joint 400 through opening 420. The flow control device 418 can include a flow restriction member that at least partially closes the opening 420 (thereby choking or restricting inflow) based on changes in the composition of formation fluids. For example, the flow restriction member can be sensitive to a change in density of the formation fluid. The flow restriction member can be formed of a material having a density that is lower than a density of a selected liquid (e.g., water) and higher than a density of a selected gas. Thus, the flow control device 418 can use the flow restriction member to move between a full flow position (e.g., open position) and a restricted flow position (e.g., closed position) as water levels in the formation fluids increases.

During later stages of production of hydrocarbons from a subterranean production zone, the rate of flow decreases or the composition of formation fluids changes due to well depletion. If water enters the production fluid, production becomes less profitable as the production fluid becomes increasingly diluted. However, it can be desirable to extract as much formation fluid as possible to maximize total production fluid recovery, even if water content of the fluid becomes high at the end of the life of a well. Therefore, it would be desirable to bypass or reduce the flow restriction of flow control device 418.

The flow control device 418 can be bypassed, or its flow restriction reduced, by creating an opening (not shown) in the base pipe 402 at position 422 under the blank housing 408. In some embodiments, a mechanical perforator (not shown in FIG. 2), which was discussed in greater detail above, can be used to perforate through the sidewall of the base pipe 402. The mechanical perforator can be positioned by lowering it downhole to engage with a locator profile 424 provided along the inner circumferential surface 426 of the screen joint 400. After creating the opening, formation fluid will preferably flow along the path of lesser resistance (e.g., through the perforated opening after passing through screen element 406 and annular chamber 410, rather than through the flow control device 418).

In various different embodiments, the base pipe 402 can be perforated at positions that are not under blank housing 408. In one example, given a second blank housing 414 having a sufficiently long axial-length, the base pipe 402 can be perforated at a position adjacent the flow control device 418 under the second blank housing 414. In another example, the base pipe 402 can be perforated at a position that is under the screen element 406 if there is a sufficiently large gap between the outer diameter of the base pipe 402 and the inner diameter of the screen element 406. Alternatively, the base pipe 402 can also be perforated at a position that is under the screen element 406 if a precise cutting tool is used that cuts through the base pipe only and does not damage the screen element 406. In each of these examples, blank housing 408 is not needed. Fluid flow from outside of the screen joint 400 can pass through screen element 406 and into the interior, axial throughbore 404 of the screen joint 400 through the perforation created under the screen element 406 or under the second blank housing 414.

Figure 5:
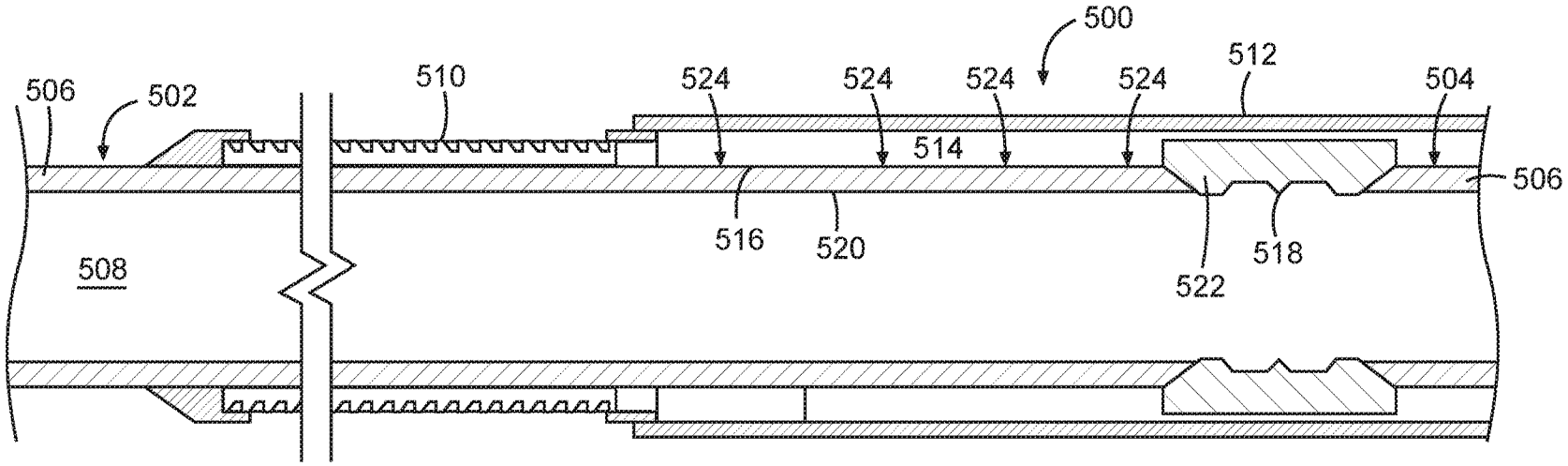
FIG. 5 is a longitudinal view of a second example of a screen joint assembly, according to one or more embodiments.

FIG. 5 is a longitudinal view of a second example of a screen joint assembly 500, according to one or more embodiments. In one embodiment, the screen joint assembly 500 comprises at least a first screen joint 502 and a second screen joint 504 that include base pipe 506 comprising a tubular member, which can be made of a material such as a steel alloy, and defining an axial throughbore 508 that allows passage of fluids. The screen joints 502,504 can be rigid tubulars that maintain their shape when deployed downhole and that allows formation fluid to pass through.

In use, the screen joints 502,504 are coupled to and form part of a completion string (such as completion string 114 described above in relation to FIG. 1) that is run into a borehole. For example, the first screen joint 502 can be coupled at both its downhole end to the uphole end of the second screen joint 504 to form a portion of the completion string. The first screen joint 502 and the second screen joint 504 are coupled together so that their axial throughbores 508 are substantially contiguous.

A screen element 510 and a blank housing 512 are positioned around the base pipe 506 so as to define an annular chamber 514 therebetween. The screen element 510 is comprised of a material that operates to allow fluid flow through, while preventing particulate materials from passing. In some embodiments, the screen element 510 comprises a wire wrap screen or another filter medium wrapped around the external circumferential surface 516 of base pipe 506.

The blank housing 512 is a permanent sleeve that is coupled to the base pipe 506. For example, the blank housing 512 can be welded or otherwise permanently coupled to the base pipe 506. In one embodiment, such as depicted in FIG. 5, the screen element 510 and blank housing 512 extend fully around the external circumferential surface 516 of the base pipe 506. Further, the axial length of the blank housing 512 can extend across multiple screen joints of the screen joint assembly (e.g., screen joints 502 and 504, as depicted). In this example, the annular chamber 514 can be concentric with the base pipe 506. In other embodiments, the screen element 510 and blank housing 512 extend partially around the external circumferential surface 516 of the base pipe 506.

While the base pipe of a conventional screen joint is often perforated to permit the passage of fluid into or from the completion string, the base pipe 506 of the first screen joint 502 and the second screen joint 504 comprises a solid tubular that is substantially impenetrable to formation fluids in the wellbore surrounding the screen joint assembly 500. The base pipe 506 does not contain any ports or openings for permitting the lateral passage of fluid. While formation fluids may pass through the screen element 510 of the screen joint assembly 500 into the annular chamber 514, formation fluids cannot enter into the interior, axial throughbore 508 since the base pipe 506 is non-perforated.

In order to allow fluid flow between the annular chamber 514 and the axial throughbore 508, a communication path must be established. Screen joint assembly 500 can be opened to fluid flow by creating an opening in the base pipe 506 under the blank housing 512. In some embodiments, a mechanical perforator (not shown in FIG. 5, but previously discussed in greater detail above) can be used to perforate through the sidewall of the base pipe 506.

The mechanical perforator can be positioned by lowering it downhole to engage with a locator profile 518 provided along the inner circumferential surface 520 of the screen joint assembly 500. As illustrated in FIG. 5, the locator profile 518 is provided at a screen joint connection 522 that couples screen joint 502 at its downhole end to screen joint 504. In some embodiments, the screen joint connection 518 can include threaded configurations (not shown) to couple screen joint 502 to screen joint 504 by threading the screen joints together. In other embodiments, the screen joint connection 522 can be made in any suitable fashion including welding, fastening using pins, set screws, and other connection mechanisms.

Those skilled in the art will readily recognize that the principles described herein are also applicable to embodiments in which the locator profile 518 is provided at a different position along the completion string. For example, in some embodiments, the locator profile 518 can be machined formed directly in the wall of the base pipe 506 along its inner circumferential surface 520. In other embodiments, the locator profile 518 can be provided in a separate sub (not shown) that is coupled inbetween screen joints along the completion string.

The non-perforated base pipe 506 serves to isolate formation fluids from the completion string by blocking inflow of production fluid from surrounding formations. When it is desired to begin production of hydrocarbons, the perforator can be run into the screen joint assembly 500 and operated to open the screen joint to permit fluid ingress for production. For example, the perforator can be operated to create openings at a plurality of positions 524 under the blank housing 512. The openings can be created at regularly spaced intervals (e.g., two feet apart) from each other.

In some embodiments, the multiple openings can be created using a perforator assembly (e.g., perforator assembly 302 as described in FIG. 3) that includes a plurality of mechanical perforators and/or cutting elements. For example, the perforator assembly can include a number of mechanical perforators (e.g., mechanical perforator 306 as described in FIG. 3) coupled together in series. Similarly, the perforator assembly can include a single mechanical perforator having an elongated, within which is positioned a plurality of cutting elements (e.g., cutting element 314 as described in FIG. 3). In other embodiments, the multiple openings can be created using a perforator assembly has a single cutting element. After creating an opening, the perforator assembly can be shifted to a different position for creating a different opening.

Although the specific embodiments have been illustrated and described herein as using mechanical perforators, it should be appreciated that non-mechanical perforators to create openings may be substituted for the specific embodiments shown. For example, hydraulic erosion perforators can be used to erode the sidewall of the base pipe via jets of slurry or other liquid mediums. This disclosure is intended to cover any and all adaptations or variations of various embodiments for opening a perforation in the base pipe.

Further, although the specific embodiments have been illustrated and described herein as having the locator profile being positioned at the downhole end of the screen joint, this disclosure is not intended to be limited to such a configuration. In other embodiments, the locator profile can be positioned uphole of the blank housing and the portion of the base pipe to be perforated. In such embodiments, the perforator assembly being run downhole would have a locator positioned uphole of the mechanical perforator, such that a cutting element of the mechanical perforator can be properly positioned at a relatively more downhole position under the portion of the base pipe to be perforated.

Figure 6:
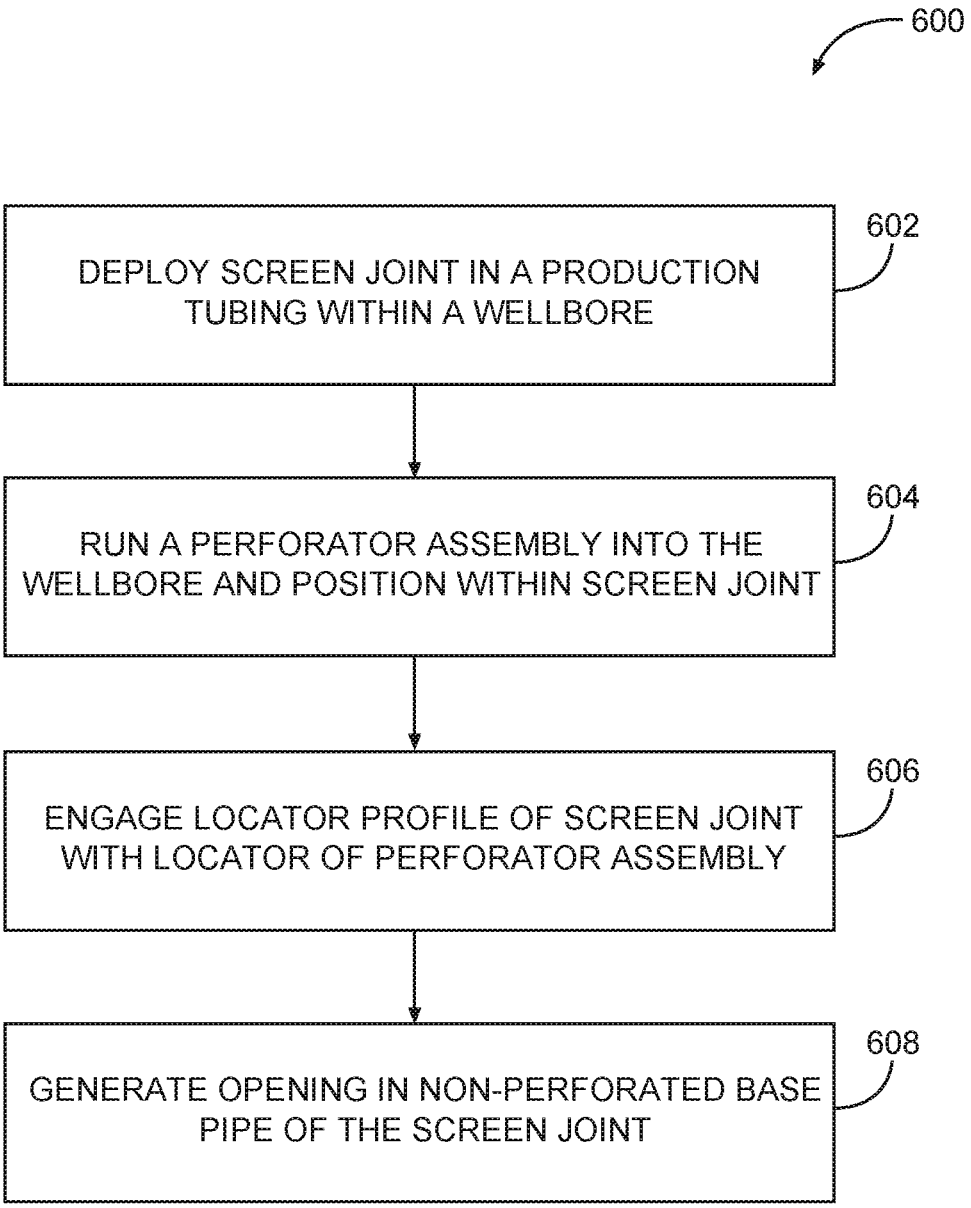
FIG. 6 is a flow diagram of an example method for opening a screen joint, according to one or more embodiments.

FIG. 6 is a flow diagram of an example method 600 for opening a screen joint, according to one or more embodiments. The method 600 begins at operation 602 by deploying a screen joint in a production tubing within a wellbore. The screen joint includes a screen element and a blank housing that are coupled to an exterior surface of a non-perforated base pipe. The screen joint couples to and forms part of production tubing (such as completion string 114 described above in relation to FIG. 1) that is run into the wellbore. For example, the screen joint can be coupled at both its uphole and downhole end to other screen joints to form a portion of the production string.

The screen joint also includes a locator profile positioned along an interior surface of the non-perforated base pipe. For example, the locator profile can be provided at a screen joint connection that couples the screen joint to other screen joints. In some embodiments, the screen joint connection can include threaded configurations for coupling screen joints together.

At operation 604, a perforator assembly is run into the wellbore to be positioned within an axial throughbore of the screen joint. For example, the perforator assembly can be lowered into production tubing on a conveyance, such as a wireline, a slickline, coiled tubing, jointed tubing, downhole robot or the like. The perforator assembly comprises a mechanical perforator and a locator. After the perforator assembly is run into the wellbore, the locator of the perforator assembly engages with the locator profile of the screen joint to position the mechanical perforator under the blank housing at operation 606.

At operation 608, an opening is generated in the non-perforated base pipe by activating the mechanical perforator. The mechanical perforator, when activated, radially extends a cutting element of the mechanical perforator outwards to cut through the non-perforated base pipe. After generating the opening, a fluid passage is formed that allows formation fluids in the wellbore to enter the axial throughbore of the screen joint. In some embodiments, the screen joint further includes a flow control device. The generated opening provides an alternate flow path that redirects fluid from away from the flow control device.

In some embodiments, the method 600 can optionally include disengaging the locator from the locator profile and running the perforator assembly to a different screen joint along the production tubing. Locator keys of the locator can be retracted and/or pushed out of engagement with the locator profile for axially re-positioning the perforator assembly. For example, the perforator assembly can be pulled uphole or pushed downhole for opening a different screen joint to fluid flow.

Many advantages can be gained by implementing the systems and methods described herein. For example, production tubing sometimes use a limited number of sliding sleeves that are expensive to construct and have opening malfunctions after being exposed to downhole environments for prolonged periods of time. Screen joints having non-perforated base pipes that can be mechanically perforated allows for operators to more economically and reliably begin fluid production. Further, creating an opening in every screen joint allows for a more even influx of fluids into the production tubing.

Although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The following numbered examples are illustrative embodiments in accordance with various aspects of the present disclosure.

1. A system may include a screen joint deployed in a production tubing within a wellbore, in which the screen joint includes a screen element and a blank housing that are coupled to an exterior surface of a non-perforated base pipe, and further in which the screen joint includes a locator profile positioned along an interior surface of the non-perforated base pipe; and a perforator assembly deployed within the screen joint, in which the perforator assembly includes a mechanical perforator and a locator for engaging with the locator profile to position the mechanical perforator under the blank housing.

2. The system of any of the preceding examples, in which an annular chamber is defined between an outer diameter of the non-perforated base pipe and an inner diameter of the blank housing.

3. The system of any of the preceding examples, in which the screen element and blank housing extend radially entirely around the external surface of the non-perforated base pipe.

4. The system of any of the preceding examples, in which the locator profile is provided at a screen joint connection at a downhole end of the screen joint.

5. The system of any of the preceding examples, in which the mechanical perforator is axially separated from the locator for positioning the mechanical perforator under the blank housing when the locator engages the locator profile.

6. The system of any of the preceding examples, in which a cutting element of the mechanical perforator is extendable radially outwards for creating an opening in the non-perforated base pipe.

7. The system of any of the preceding examples, in which the opening is created at a position under the blank housing.

8. The system of any of the preceding examples, further including a second blank housing coupled to the exterior surface of the non-perforated base pipe, and in which a flow control device is positioned in an annular space between the second blank housing and the non-perforated base pipe.

9. The system of any of the preceding examples, in which the blank housing axially extends across a plurality of screen joints of the production tubing.

10. A method includes deploying a screen joint in a production tubing within a wellbore, in which the screen joint includes a screen element and a blank housing that are coupled to an exterior surface of a non-perforated base pipe, and further in which the screen joint includes a locator profile positioned along an interior surface of the non-perforated base pipe; running a perforator assembly into the wellbore to be positioned within an axial throughbore of the screen joint, in which the perforator assembly includes a mechanical perforator and a locator; engaging the locator of the perforator assembly with the locator profile of the screen joint to position the mechanical perforator under the blank housing; and generating an opening in the non-perforated base pipe by activating the mechanical perforator.

11. The method of example 10, in which activating the mechanical perforator includes radially extending a cutting element of the mechanical perforator outwards to cut through the non-perforated base pipe.

12. The method of any of examples 10-11, in which generating the opening allows formation fluids in the wellbore to enter the axial throughbore of the screen joint.

13. The method of any of examples 10-12, further including disengaging the locator from the locator profile and running the perforator assembly to a different screen joint along the production tubing.

14. The method of any of examples 10-13, in which generating the opening further includes generating a bypass opening that redirects fluid from away from a flow control device of the screen joint.

15. An apparatus includes a non-perforated base pipe defining an axial fluid passage; a screen element and a blank housing coupled to an exterior surface of the non-perforated base pipe; and a locator profile positioned along an interior surface of the non-perforated base pipe.

16. The apparatus of example 15, in which an annular chamber is defined between an outer diameter of the non-perforated base pipe and an inner diameter of the blank housing.

17. The apparatus of any of the preceding examples, in which formation fluids are filtered by the screen element before entering the annular chamber 18. The apparatus of any of the preceding examples, in which the screen element and blank housing extend radially entirely around the external surface of the non-perforated base pipe.

19. The apparatus of any of the preceding examples, in which the locator profile is provided at a screen joint connection at a downhole end of the non-perforated base pipe.

20. The apparatus of any of the preceding examples, further including a second blank housing coupled to the exterior surface of the non-perforated base pipe, and in which a flow control device is positioned in an annular space between the second blank housing and the non-perforated base pipe.

The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

What is claimed is:

1. A system, comprising:

a screen joint deployed in a production tubing within a wellbore, wherein the screen joint comprises a screen element and a blank housing that are coupled to an exterior surface of a non-perforated base pipe, and further wherein the screen joint comprises a locator profile positioned along an interior surface of the non-perforated base pipe;

a second blank housing coupled to the exterior surface of the non-perforated base pipe, and wherein a flow control device is positioned in an annular space between the second blank housing and the non-perforated base pipe, and a perforator assembly deployed within the screen joint, wherein the perforator assembly comprises a mechanical perforator and a locator for engaging with the locator profile to position the mechanical perforator under the blank housing.

2. The system of claim 1, wherein an annular chamber is defined between an outer diameter of the non-perforated base pipe and an inner diameter of the blank housing.

3. The system of claim 1, wherein the screen element and blank housing extend radially entirely around the external surface of the non-perforated base pipe.

4. The system of claim 1, wherein the locator profile is provided at a screen joint connection at a downhole end of the screen joint.

5. The system of claim 1, wherein the mechanical perforator is axially separated from the locator for positioning the mechanical perforator under the blank housing when the locator engages the locator profile.

6. The system of claim 1, wherein a cutting element of the mechanical perforator is extendable radially outwards for creating an opening in the non-perforated base pipe.

7. The system of claim 6, wherein the opening is created at a position under the blank housing.

8. The system of claim 1, wherein the blank housing axially extends across a plurality of screen joints of the production tubing.

9. A method, comprising:

deploying a screen joint in a production tubing within a wellbore, wherein the screen joint comprises a screen element and a blank housing that are coupled to an exterior surface of a non-perforated base pipe, and further wherein the screen joint comprises a locator profile positioned along an interior surface of the non-perforated base pipe, positioning a flow control device in an annular space between a second blank housing coupled to the exterior surface of the non-perforated base pipe and the non-perforated base pipe;

running a perforator assembly into the wellbore to be positioned within an axial throughbore of the screen joint, wherein the perforator assembly comprises a mechanical perforator and a locator;

engaging the locator of the perforator assembly with the locator profile of the screen joint to position the mechanical perforator under the blank housing; and generating an opening in the non-perforated base pipe by activating the mechanical perforator.

10. The method of claim 9, wherein activating the mechanical perforator comprises radially extending a cutting element of the mechanical perforator outwards to cut through the non-perforated base pipe.

11. The method of claim 9, wherein generating the opening allows formation fluids in the wellbore to enter the axial throughbore of the screen joint.

12. The method of claim 9, further comprising: disengaging the locator from the locator profile and running the perforator assembly to a different screen joint along the production tubing.

* * * * *